United States Patent [19]

Berry et al.

[11] Patent Number: 4,647,099

[45] Date of Patent: Mar. 3, 1987

[54] LIFTING HEAD

[75] Inventors: Joe R. Berry; Archie L. Black, both of Round Rock; William R. Hamilton, Georgetown, all of Tex.

[73] Assignee: Hughes Tool Company, Houston, Tex.

[21] Appl. No.: 826,032

[22] Filed: Feb. 4, 1986

[51] Int. Cl.[4] ..... E21B 19/14

[52] U.S. Cl. ..... 294/103.1; 294/88; 294/90; 294/902

[58] Field of Search ..... 294/86.1, 86.26, 86.3–86.32, 294/88, 90–91, 102.1, 102.2, 103.1, 104, 106, 114, 902; 414/22

[56] References Cited

U.S. PATENT DOCUMENTS

| | | | |
|---|---|---|---|
| 711,911 | 10/1902 | Smith | 294/102.2 |
| 1,487,440 | 3/1924 | Butts | 294/102.1 X |
| 1,511,061 | 10/1924 | Nebergall | 294/102.1 X |
| 2,048,208 | 7/1936 | Young et al. | 294/90 |
| 2,615,682 | 10/1952 | Stone | 81/57.21 |
| 3,329,460 | 7/1967 | Sprague | 294/103.1 X |
| 3,937,515 | 2/1976 | Langowski | 294/90 X |
| 4,126,348 | 11/1978 | Palmer | 294/88 |
| 4,269,554 | 5/1981 | Jackson | 294/90 X |
| 4,304,433 | 12/1981 | Langowski | 414/22 X |

*Primary Examiner*—Johnny D. Cherry
*Attorney, Agent, or Firm*—H. Dennis Kelly

[57] ABSTRACT

A lifting head having a gate arm, and a latch arm, pivotally secured to a frame. A clamping block, also mounted on the frame, is movable between a retracted position away from the drill collar and an extended position against the drill collar. A plurality of gripping inserts are located on the clamping block and on the gate arm. Each insert has a body and a plurality of teeth. The bodies of the inserts may be vertical or angled, but the teeth of the inserts are mounted in a spiral. This allows the inserts to grip the drill collar, even if the lifting head grips the collar at a place having a spiral groove.

7 Claims, 9 Drawing Figures

LIFTING HEAD

BACKGROUND OF THE INVENTION

1. Field of the Invention:

This invention relates in general to oil well drilling equipment. In particular, the invention relates to lifting heads for handling drill collars.

2. Description of the Prior Art:

Drill collars are heavy, thick-walled tubular members, located in a drill stem between the drill pipe and the bit. The purpose of the drill collar is to place weight on the bit in order to improve the bit's performance. Unlike sections of drill pipe, drill collars usually do not have upset sections at each end. Lifting heads for drill collars must, therefore, grip the drill collar surface, or a sub must be added to the drill collar.

Some drill collars have spiral cuts which cover practically the entire length of the drill collar. These spiral cuts prevent, or at least greatly reduce the likelihood of, differential wall sticking. If a lifting head engages a drill collar in an area which has a spiral cut, the gripping inserts on the lifting head may not contact the surface of the collar.

SUMMARY OF THE INVENTION

The lifting head of the invention may be used to handle drill collars. Even if the lifting head engages the drill collar in a section having a spiral cut, the gripping inserts of the lifting head will grip the drill collar.

The lifting head of the invention has a gate arm and a latch arm, pivotally secured to a frame. The gate arm and the latch arm engage one another when closed around a drill collar.

The frame of the lifting head also has a clamping block, which is reciprocally movable between a retracted position and an extended position. In the extended position, the clamping block pushes the drill collar against the gate arm. A hydraulic clamping cylinder moves the clamping block reciprocally between the retracted position and the extended position.

The clamping block and the gate arm have a plurality of insert slots. A gripping insert, having a body and a plurality of teeth, is located within each insert slot. The teeth are mounted in a spiral, so that the gripping insert can grip the spiral groove of the drill collar. Additional objects, features, and advantages of the invention, will become apparent in the following detailed description.

DESCRIPTION OF THE PREFERRED EMBODIMENT

As shown in FIGS. 1–4, the lifting head of the invention has a frame 11. A pair of supports 13 extend upward from the frame 11. An adapter 15 is connected between the tops of the two supports 13, and provides a means for connecting the lifting head to a means for raising, lowering, and moving the lifting head.

Figure 9:
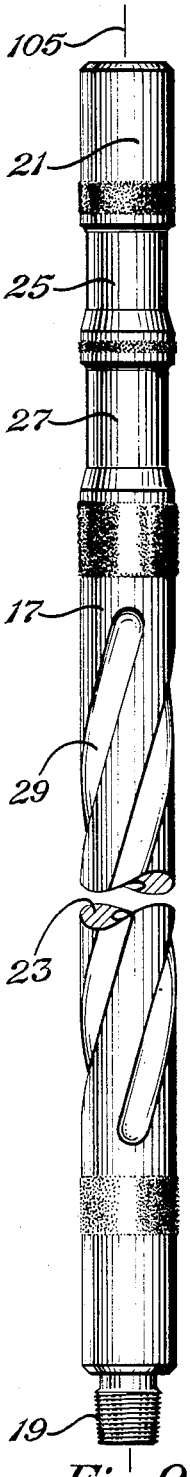
FIG. 9 is a side view of a drill collar with spiral grooves.

The lifting head of the invention is designed to lift a drill collar, such as the drill collar 17 shown in FIG. 9. The drill collar 17 has a threaded pin connection 19 on the lower end and a threaded box connection 21 at the upper end. The drill collar 17 has a thick wall 23, and is much heavier than a typical section of drill pipe. Several drill collars 17 may be placed in a drill string in order to add weight to the string, to improve the performance of the drill bit.

The drill collar 17 shown in FIG. 9 has a recessed portion 25 near the upper end, so that an elevator can be connected to the collar 17. A second recessed portion 17 is provided so that slips can be attached to the collar 17. Many drill collars 17 do not have such recessed portions 25,27, however, or the lifting head may have to grip the collar 17 at a position other than at a recessed portion 25,27.

Three spiral grooves 29 are cut into the surface of the drill collar 17, in order to reduce the likelihood of the drill collar 17 becoming stuck in the borehole. The spiral grooves 29 have a right hand spiral, and are approximately an eighth inch to a half inch deep, depending on the size of the drill collar 17.

The lifting head of the invention has a trigger 31, which is pivotally mounted on top of the frame 11. A cam 33 is mounted on top of the trigger 31, and rotates with the trigger 31 about the same trigger shaft 35. A spring 37, mounted on the trigger shaft 35 above the cam 33, exerts pressure against one of the supports 13 and on a spring pin 39 on the cam 33, to bias the trigger 31 in the position shown in FIGS. 1–3.

A trigger valve 41 is attached to a trigger valve mount 43, which is secured to the top of the frame 11. The trigger valve 41 has an extension 45, which extends to the cam 33. When the trigger 31 is opened, the cam 33 pushes on the extension 45 to activate the trigger valve 41.

Figure 3:
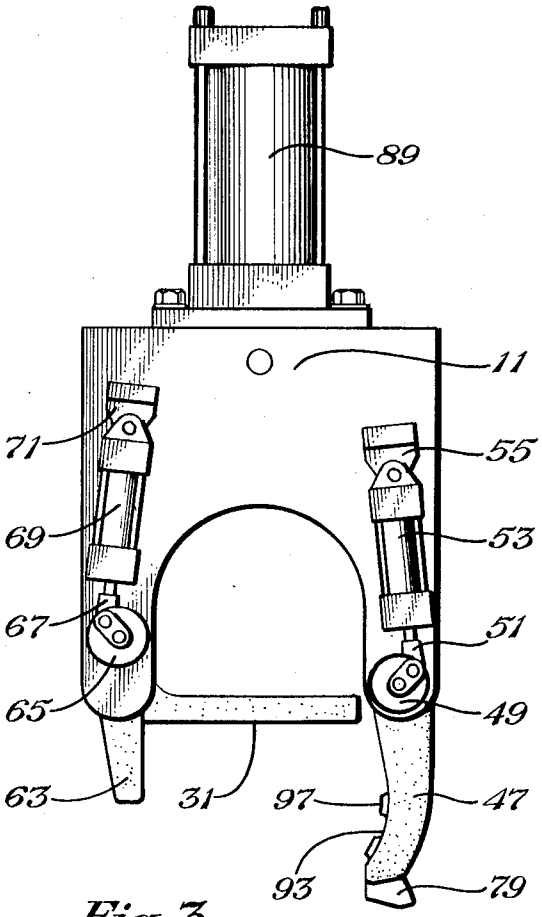
FIG. 3 is a bottom view of the lifting head of the invention.

On the opposite side of the frame 11 from the trigger 31, a gate arm 47 is pivotally secured to the frame 11 by a pivot pin 49. As shown in FIG. 3, the pivot pin 49 is connected to the end of a piston rod 51, which is connected to a hydraulic cylinder 53. The hydraulic cylinder 53 is attached to a cylinder mount 55 on the frame 11. The hydraulic cylinder 53 is the means for pivoting the gate arm 47 between an open position and a closed position.

Figure 4:
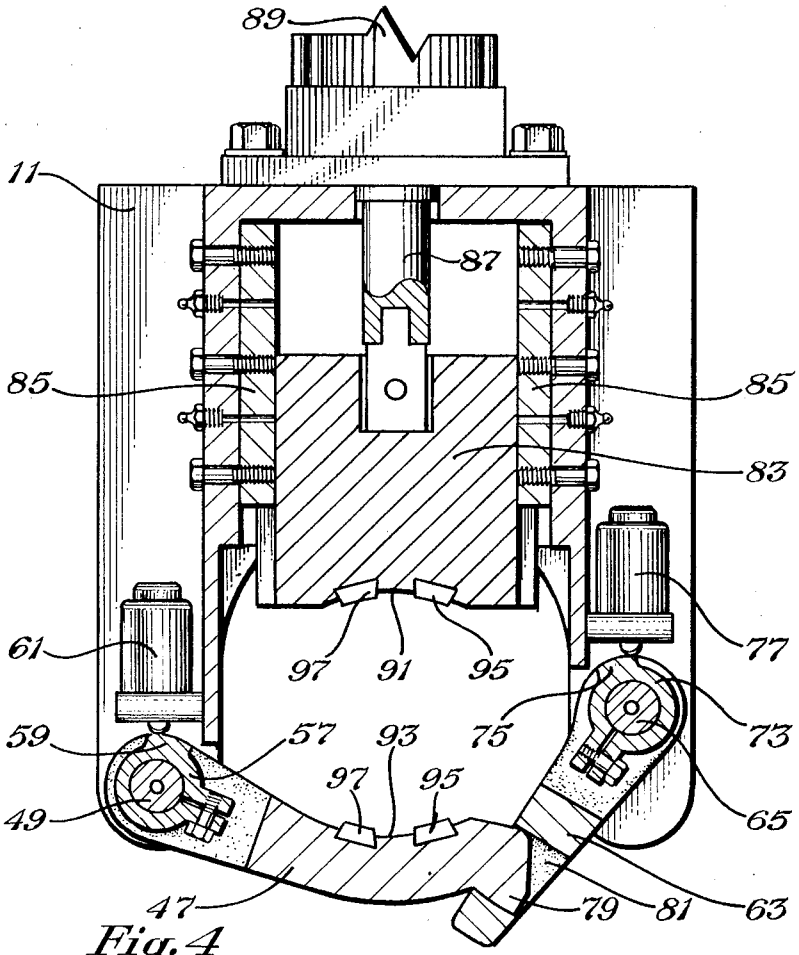
FIG. 4 is a sectional view of the lifting head of the invention as seen along lines IV—IV in FIG. 1.

As shown in FIG. 4, a secondary valve actuator 57 is located around the pivot pin 49 for rotation with the gate arm 47. A cam 59, on the secondary valve actuator 57, actuates a valve 61 on the frame 11, whenever the gate arm 47 is in the closed position, as shown in FIG. 4.

Across from the gate arm 47, a latch arm 63 is pivotally secured to the frame 11 by a pivot pin 65. A piston rod 67 is connected between the pivot pin 65 and a hydraulic cylinder 69. The hydraulic cylinder 69 is attached to a cylinder mount 71 on the frame 11. The hydraulic cylinder 69 is the means for pivoting the latch arm 63 between an open position and a closed position.

As shown in FIG. 4, a secondary valve actuator 73 is located around the pivot pin 65 for rotation with the latch arm 63. A cam 75, on the secondary valve actuator 73, triggers a valve 77, whenever the latch arm 63 is in the closed position as shown in FIG. 4.

The gate arm 47 has a single tooth, or extension 79 on the outer end. When the gate arm 47 and the latch arm 63 are in the closed position, the tooth 79 fits within an opening 81 in the latch arm 63. The latch arm 63 thus secures the gate arm 47 in the closed position.

A clamping block 83 is mounted in the frame 11, between a pair of slides 85 The clamping block 83 is for pushing the drill collar 17 against the gate arm 47. The clamping block 83 is attached to a piston rod 87, which extends from a hydraulic cylinder 89. The clamping block 83 is thus movable between a retracted position, away from the drill collar 17, and an extended position against the drill collar 17. The hydraulic cylinder 89 and the piston rod 87 are the means for moving the clamping block 83 between the retracted and extended positions.

The clamping block 83 has a curved face 91, which opposes the curved inner surface 93 of the gate arm 47. The face 91 of the clamping block 83 and the inner surface 93 of the gate arm 47 each have a pair of insert slots 95. A gripping insert 97 is located within each insert slot 95, and held in place by an insert retainer 99. The gripping inserts 97 are for gripping the outer surface of the drill collar 17.

Figure 5:
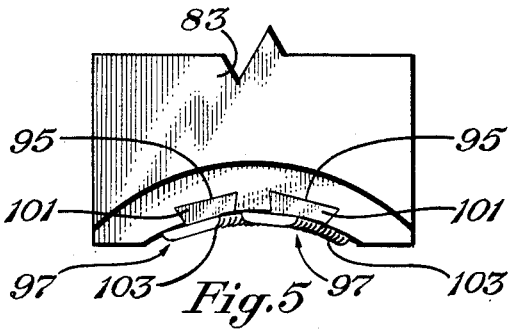
FIG. 5 is a top view of the clamping block in a lifting head of the invention.
Figure 6:
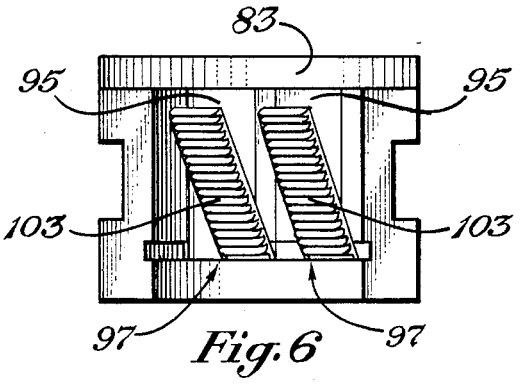
FIG. 6 is a side view of the clamping block in a lifting head of the invention.

FIGS. 5–8 show two possible embodiments of the gripping inserts 97. In FIGS. 5 and 6, the insert slots 95 are vertical. Each gripping insert 97 has a body 101 and a plurality of teeth 103. The body 101 of the insert 97 fits within an insert slot 95. However, the teeth 103 are angled at about 24 degrees to the longitudinal axis 105 of the drill collar 17. The teeth 103 are thus mounted in a spiral, and constitute a spiral gripping surface, so that the gripping insert 97 can grip the spiral grooves 29 of the drill collar 17.

Figure 7:
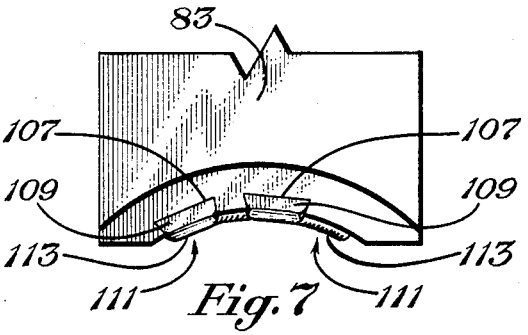
FIG. 7 is a top view of an alternate embodiment of the clamping block in a lifting head of the invention.
Figure 8:
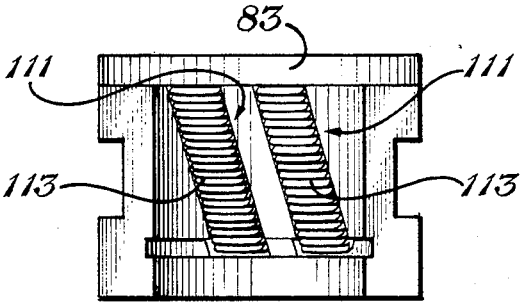
FIG. 8 is a side view of an alternate embodiment of the clamping block in a lifting head of the invention.

In the embodiment shown in FIGS. 7 and 8, the insert slots 107 and the bodies 109 of the gripping inserts 111 are angled at the same angle as the teeth 113. The teeth 113 are angled at about 24 degrees to the longitudinal axis 105 of the drill collar 17. The teeth 113 are thus mounted in a spiral, and constitute a spiral gripping surface, so that the gripping insert 111 can grip the spiral grooves 29 of the drill collar 17.

Figure 2:
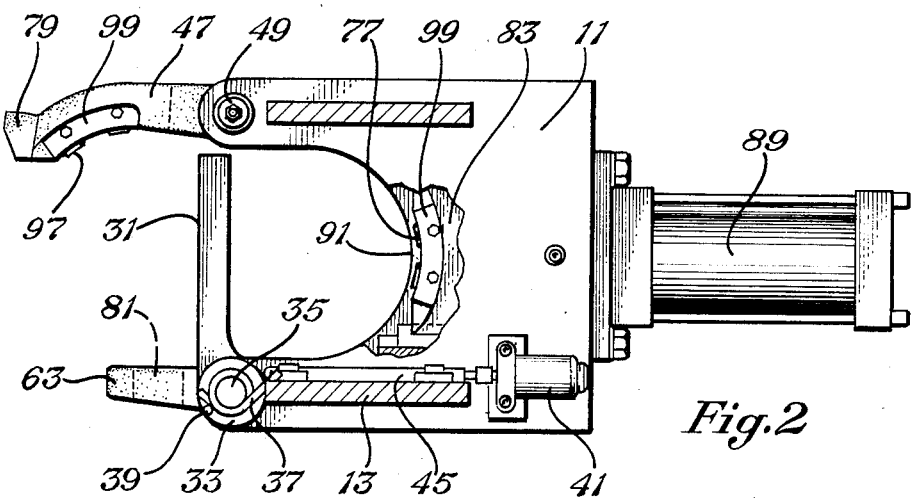
FIG. 2 is a sectional view of the lifting head as seen along line II—II in FIG. 1.
Figure 1:
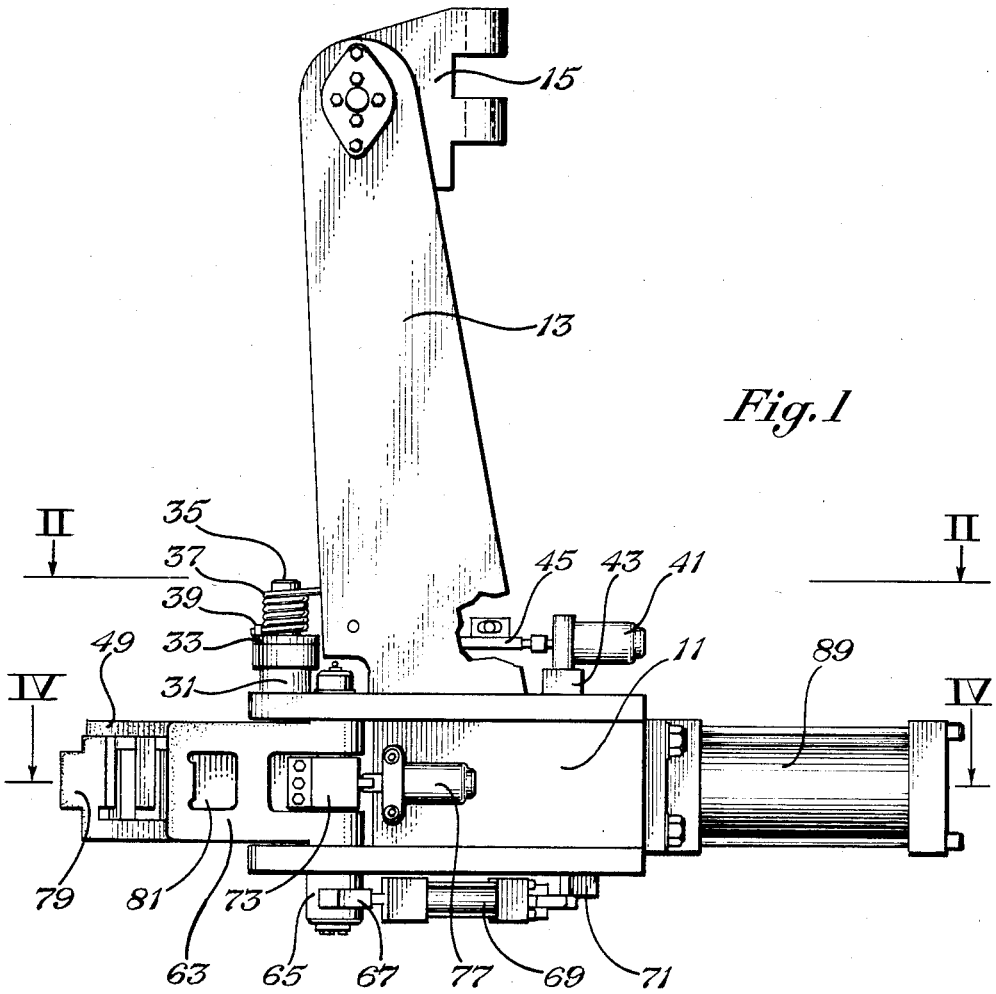
FIG. 1 is side view of a lifting head of the invention.

In operation, the lifting head of the invention is used to handle drill collars 17. The gate arm 47 and the latch arm 63 are first moved to the open position, as shown in FIGS. 1–3. The gate arm 47 and the latch arm 63 are opened by activating the hydraulic cylinders 53, 69 to retract the piston rods 51, 67.

As the lifting head is moved onto the drill collar 17, the drill collar 17 strikes the trigger 31, and causes the trigger 31 to pivot. The cam 33 rotates with the trigger 31, and pushes the extension 45 toward the trigger valve 41.

The trigger valve 41 signals that the trigger 31 has been pivoted, and hydraulic cylinder 53 is activated. The cylinder 53 extends the piston rod 51 to close the gate arm 47. Hydraulic cylinder 69 is then activated to extend piston rod 67, closing the latch arm 63. The tooth 79 on the gate arm 47 enters the opening 81 in the latch arm 63.

The hydraulic cylinder 89 is then activated to move the clamping block 83 toward the drill collar 17. The clamping block 83 pushes the drill collar 17 against the gate arm 47. The gripping inserts 97 on the clamping block 83 and on the gate arm 47 grip the drill collar 17, so that the drill collar 17 can be lifted.

The lifting head of the invention has several advantages over the prior art. The gripping inserts 97 allow the lifting head to grip the outside surface of the drill collar 17, and thus eliminate the need for a lifting shoulder. Also, since the inserts are angled, the inserts 97 will make sufficient contact with the drill collar 17, even if the lifting head grips the collar 17 at a point that includes a spiral groove 29.

The invention has been shown in only two of its forms. It should be apparent to those skilled in the art that it is not so limited, but is susceptible to various changes and modifications without departing from the spirit thereof.

We claim:

1. A lifting head for lifting a drill collar, the lifting head comprising:

a frame;

a gate arm, pivotally secured to the frame;

a latch arm, pivotally secured to the frame;

a clamping block, reciprocally movable between a retracted position away from the drill collar and an extended position against the drill collar;

means for moving the clamping block reciprocally between the retracted position and the extended position, to force the drill collar against the gate arm;

means for pivoting the gate arm between an open position and a closed position;

means for pivoting the latch arm between an open position and a closed position;

a gripping insert, on the clamping block, for gripping the drill collar, the gripping insert having a plurality of teeth, the teeth being mounted in a spiral.

2. A lifting head for lifting a drill collar, the lifting head comprising:

a frame;

a gate arm, pivotally secured to the frame;

a latch arm, pivotally secured to the frame;

a clamping block, reciprocally movable between a retracted position away from the drill collar and an extended position against the drill collar;

means for moving the clamping block reciprocally between the retracted position and the extended position, to force the drill collar against the gate arm;

means for pivoting the gate arm between an open position and a closed position;

means for pivoting the latch arm between an open position and a closed position;

a gripping insert, on the clamping block, for gripping the drill collar, the gripping insert having a spiral gripping surface.

3. A lifting head for lifting a drill collar having spiral grooves, the lifting head comprising:

a frame;

a gate arm, pivotally secured to the frame;

a latch arm, pivotally secured to the frame;

a clamping block, reciprocally movable between a retracted position away from the drill collar and an extended position against the drill collar;

means for moving the clamping block reciprocally between the retracted position and the extended position, to force the drill collar against the gate arm;

means for pivoting the gate arm between an open position and a closed position;

means for pivoting the latch arm between an open position and a closed position;

a plurality of gripping inserts, on the clamping block and on the gate arm, for gripping the drill collar, the gripping inserts having spiral gripping surfaces.

4. A lifting head for lifting a drill collar having spiral grooves, the lifting head comprising:

a frame;

a gate arm, pivotally secured to the frame;

a latch arm, pivotally secured to the frame;

a clamping block, reciprocally movable between a retracted position away from the drill collar and an extended position against the drill collar;

means for moving the clamping block reciprocally between the retracted position and the extended position, to force the drill collar against the gate arm;

means for pivoting the gate arm between an open position and a closed position;

means for pivoting the latch arm between an open position and a closed position;

a gripping insert, on the clamping block, for gripping the drill collar, the gripping insert having a spiral gripping surface, so that the gripping insert can grip the spiral grooves of the drill collar.

5. A lifting head for lifting a drill collar having spiral grooves, the lifting head comprising:

a frame;

a gate arm, pivotally secured to the frame;

a latch arm, pivotally secured to the frame;

a clamping block, reciprocally movable between a retracted position away from the drill collar and an extended position against the drill collar;

means for moving the clamping block reciprocally between the retracted position and the extended position, to force the drill collar against the gate arm;

means for pivoting the gate arm between an open position and a closed position;

means for pivoting the latch arm between an open position and a closed position;

a plurality of gripping inserts, on the clamping block and on the gate arm, for gripping the drill collar, the gripping inserts having a spiral gripping surface, so that the gripping inserts can grip the spiral grooves of the drill collar.

6. A lifting head for lifting a drill collar having spiral grooves, the lifting head comprising:

a frame;

a gate arm, pivotally secured to the frame;

a latch arm, pivotally secured to the frame;

a clamping block, reciprocally movable between a retracted position away from the drill collar and an extended position against the drill collar, the clamping block having a vertical insert slot;

means for moving the clamping block reciprocally between the retracted position and the extended position, to force the drill collar against the gate arm;

means for pivoting the gate arm between an open position and a closed position;

means for pivoting the latch arm between an open position and a closed position;

a gripping insert, on the clamping block, for gripping the drill collar, the gripping insert having a body and a plurality of teeth, the body being located in the insert slot, and the teeth being mounted in a spiral, so that the gripping insert can grip the spiral grooves of the drill collar.

7. A lifting head for lifting a drill collar having spiral grooves, the lifting head comprising:

a frame;

a gate arm, pivotally secured to the frame, the gate arm having a plurality of vertical insert slots;

a latch arm, pivotally secured to the frame;

a clamping block, reciprocally movable between a retracted position away from the drill collar and an extended position against the drill collar, the clamping block having a plurality of vertical insert slots;

means for moving the clamping block reciprocally between the retracted position and the extended position, to force the drill collar against the gate arm;

means for pivoting the gate arm between an open position and a closed position;

means for pivoting the latch arm between an open position and a closed position;

a plurality of gripping inserts, on the clamping block and on the gate arm, for gripping the drill collar, each gripping insert having a body and a plurality of teeth, each body being located in an insert slot, and the teeth being mounted in a spiral, so that the gripping inserts can grip the spiral grooves of the drill collar.

* * * * *